US010088191B2

(12) United States Patent
Suhara et al.

(10) Patent No.: US 10,088,191 B2
(45) Date of Patent: Oct. 2, 2018

(54) OCCUPANCY BASED CONTROL OF AIR CONDITIONING SYSTEM

(71) Applicant: DAIKIN INDUSTRIES, LTD., Osaka-shi, Osaka (JP)

(72) Inventors: Ryouta Suhara, Osaka (JP); Takayoshi Yamamoto, Osaka (JP); Tsuyoshi Yokomizo, Osaka (JP); Tomoo Masuda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 170 days.

(21) Appl. No.: 14/912,358

(22) PCT Filed: Jul. 1, 2014

(86) PCT No.: PCT/JP2014/003501

§ 371 (c)(1),
(2) Date: Feb. 16, 2016

(87) PCT Pub. No.: WO2015/045228

PCT Pub. Date: Apr. 2, 2015

(65) Prior Publication Data

US 2016/0201936 A1 Jul. 14, 2016

(30) Foreign Application Priority Data

Sep. 24, 2013 (JP) ..... 2013-196872

(51) Int. Cl.
*F24F 11/30* (2018.01)
*F24F 3/044* (2006.01)
(Continued)

(52) U.S. Cl.
CPC ..... *F24F 11/30* (2018.01); *F24F 3/044* (2013.01); *F24F 3/065* (2013.01); *F24F 11/46* (2018.01);
(Continued)

(58) Field of Classification Search
CPC .. F24F 11/0034; F24F 11/006; F24F 11/0079; F24F 3/044; F24F 3/065;
(Continued)

(56) References Cited

U.S. PATENT DOCUMENTS 4,407,447 A 10/1983 Sayegh
5,279,458 A * 1/1994 DeWolf ..... F24F 11/00 236/47
(Continued)

FOREIGN PATENT DOCUMENTS

JP 2009-115359 A 5/2009
JP 2010-91144 A 4/2010
(Continued)

OTHER PUBLICATIONS

International Search Report issued in PCT/JP2014/003501, dated Sep. 22, 2014.

*Primary Examiner* — Travis Ruby
(74) *Attorney, Agent, or Firm* — Birch, Stewart, Kolasch & Birch, LLP

(57) ABSTRACT

False determination in the presence or absence of a person in a in a room is limited. An air conditioner suspends an air conditioning operation if a room is vacant. If at least one of motion detectors, each provided to one of the indoor units, starts to detect the presence of a person during suspension of the air conditioning operation, an indoor controller of an indoor unit sums, for each of the motion detectors, time periods in which the presence of the person is detected to obtain a detection time period sum. If any one of detection time period sums, each for one of the motion detectors, reaches a reference value within a predetermined time period, the outdoor controller causes the air conditioner to resume the air conditioning operation.

12 Claims, 7 Drawing Sheets

(51) Int. Cl.

| | |
|---|---|
| *F24F 120/10* | (2018.01) |
| *F24F 11/61* | (2018.01) |
| *F24F 11/46* | (2018.01) |
| *F24F 3/06* | (2006.01) |

(52) U.S. Cl.
CPC ..... *F24F 11/61* (2018.01); *F24F 2120/10* (2018.01); *F25B 2600/0251* (2013.01)

(58) Field of Classification Search
CPC ..... F24F 2011/0035; F24F 2011/0056; F24F 2011/0063; F24F 2011/0073; F24F 2011/0075; F25B 2600/0251
See application file for complete search history.

(56) References Cited

U.S. PATENT DOCUMENTS

| | | | | |
|---|---|---|---|---|
| 6,792,319 | B1 | 9/2004 | Bilger | |
| 2002/0134849 | A1 | 9/2002 | Disser | |
| 2010/0174414 | A1* | 7/2010 | Takagi | F24F 3/065 700/278 |
| 2010/0241287 | A1 | 9/2010 | Nishino et al. | |
| 2012/0085831 | A1 | 4/2012 | Kopp | |
| 2012/0296487 | A1* | 11/2012 | Leinen | F24F 11/30 700/296 |
| 2013/0008198 | A1* | 1/2013 | Inui | F24F 11/30 62/222 |

FOREIGN PATENT DOCUMENTS

| | | | |
|---|---|---|---|
| JP | 2010-257611 | A | 11/2010 |
| JP | 2011-185591 | A | 9/2011 |

* cited by examiner

OCCUPANCY BASED CONTROL OF AIR CONDITIONING SYSTEM

TECHNICAL FIELD

The present invention relates to an air conditioning system which limits false determination, in presence or absence of a person in a room, when multiple indoor units each equipped with a motion detector are installed in the room.

BACKGROUND ART

Among indoor units, some of them such as an indoor unit in Document 1 include a motion detector (i.e., an occupancy sensor) which detects presence of a person in a room. The indoor unit of Patent Document 1 adjusts, for example, an angle of its horizontal vane acting as a flap, in accordance with the result of the detection by the motion detector.

CITATION LIST

Patent Document

Patent Document 1: Japanese Unexamined Patent Publication No. 2011-185591

SUMMARY OF THE INVENTION

Technical Problem

The motion detector detects a person even when the person simply passes through a room. The indoor unit of Patent Document 1 could then falsely determine that the passing person is an occupant of the room as the result of the detection by the motion detector, and might carry out an air conditioning operation.

Furthermore, there is another case to be considered where multiple indoor units are installed in a room in the form of a single control system. If, in such a case, the air conditioning operation is resumed in accordance with a change in degree of occupancy of the room from a vacant state to an in-use state, the false determination due to the passing person will cause wasteful consumption of power among all the indoor units.

In view of the forgoing background, it is therefore an object of the present invention to avoid false determination in presence or absence of a person in a room.

Solution to the Problem

A first aspect of the present invention is directed to an air conditioning system comprising: an air conditioner (20) including an outdoor unit (30) and indoor units (40) belonging to a common control system, the indoor units being installed in a common room (10); motion detectors (50) each provided to one of the indoor units (40), and configured to detect presence of a person in the room (10); and a controller (37, 45) configured to cause the air conditioner (20) to suspend an air conditioning operation if the room (10) is vacant. While the air conditioning operation is suspended, the controller (37, 45): obtains a detection time period sum by summing, for each of the motion detectors (50), time periods in which the presence of the person is detected, if at least one of the motion detectors (50), each provided to one of the indoor units (40), starts to detect the presence of the person during the suspension of the air conditioning operation; and causes the air conditioner (20) to resume the air conditioning operation if any one of detection time period sums, including the detection time period sum and each for one of the motion detectors (50), reaches a reference value (T2) within a predetermined time period (T3) after the at least one motion detector (50) starts to detect the presence of the person.

In the first aspect, the air conditioner (20) suspends the air conditioning operation when the room (10) is vacant. When the degree of occupancy of the room (10) changes from the vacant state to the in-use state, a detection time period sum is obtained for each of the motion detectors (50). The actual degree of occupancy in the room (10) is determined based on the detection time period sum. If the room (10) is actually in use, the air conditioning operation is resumed. Such features may limit, for example, false determination—that is, a person simply passing through the room (10) is determined to be the occupant of the room (10)—, and the resulting resumption of the air conditioning operation.

The limitation of resuming the air conditioning operation may avoid wasteful consumption of power among all the indoor units (40).

In a second aspect of the present invention according to the first aspect, each indoor unit (40) may include: an indoor casing (41) having an outlet (41*c*) from which air is blown into the room (10); a flap (44) placed to, and capable of opening and closing, the outlet (41*c*); and an indoor fan (43) creating a flow of the air blown from the outlet (41*c*). The controller (37, 45) may close the flap (44) and stop the indoor fan (43) during the suspension of the air conditioning operation.

Such features allow the indoor units (40) to appear to stop their operations during the suspension of the air conditioning operation. Hence, a person entering the vacant room (10) may confirm that the indoor units (40) had actually stopped operating when nobody was present there. Moreover, the features allow for reducing the power consumption of the air conditioner (20) because the indoor fan (43) stops during the suspension of the air conditioning operation.

In a third aspect of the present invention according to one of the first aspect or the second aspect, the controller (37, 45) may stop the compressor (32) included in the outdoor unit (30), during the suspension of the air conditioning operation.

Such a feature allows for reducing the power consumption of the air conditioner (20) during the suspension of the air conditioning operation.

In a fourth aspect of the present invention according to any one of the first to third aspects, the controller (37, 45) may cause the air conditioner (20) to suspend the air conditioning operation, if determining for all the indoor units (40) that the room (10) is vacant.

Here, if the controller (37, 45) of all the indoor units (40) determine during the air conditioning operation that the room (10) is vacant, the room (10) is determined to be reliably vacant, and the air conditioning operation is suspended. Such a feature allows for limiting the suspension of the air conditioning operation when the room (10) might possibly be in use—that is, for example, when the indoor controller (45) of any one of the indoor units (40) determines that there is an occupant.

In a fifth aspect of the present invention according to any one of the first to fourth aspects, the air conditioning system may further comprise a receiver (62) configured to be capable of selectively receiving one of: a first mode for obtaining the detection time period sum for each motion detector (50); or a second mode for collecting time periods in which the presence of the person is detected by at least two of the motion detectors (50), and obtain the detection time period sum by summing the collected time periods, each of the motion detectors (50) being provided to one of the indoor units (40).The controller (60) may obtain the detection time period sum in accordance with one of the first mode or the second mode received by the receiver (62).

If the first mode is selected, a detection time period sum is obtained for each of the motion detectors (50). If the second mode is selected, the time periods detected by the multiple motion detectors (50) are summed to be a detection time period sum. As a result, the second mode allows for determining, relatively more quickly than the first mode does, whether the room (10) is in use.

In a sixth aspect of the present invention according to the fifth invention, in the second mode, the receiver (62) may be further capable of receiving a setting to rule out a motion detector (50), of a predetermined one of the indoor units (40), from among targets for obtaining the detection time period sum, the ruled out motion detector being included in the motion detectors (50).

The second mode tends to cause a false detection of presence or absence of a person if targets for obtaining the detection time period sum include the motion detector of an indoor unit at a busy location such as a doorway of the room. In comparison, the sixth aspect allows for ruling out the motion detector (50), of the indoor unit (40) at the busy location, from among the targets for obtaining the detection time period sum, thereby further limiting false determination of presence or absence of a person.

ADVANTAGES OF THE INVENTION

The present invention may limit, for example, false determination—that is, a person simply passing through the room (10) is determined to be the occupant of the room (10)—, and the resulting resumption of the air conditioning operation. The limitation of resuming the air conditioning operation may avoid wasteful consumption of power among all the indoor units.

The second aspect of the present invention enables a person entering the vacant room (10) to confirm that the indoor units (40) had actually stopped operating when nobody was present there. The second aspect of the present invention allows for reducing the power consumption of the air conditioner (20) during the suspension of the air conditioning operation.

The third aspect of the present invention may reduce the power consumption of the air conditioner (20) during the suspension of the air conditioning operation.

The fourth aspect of the present invention may limit the suspension of the air conditioning operation when the room (10) might possibly be in use.

In the fifth aspect of the present invention, the second mode allows for determining, relatively more quickly than the first mode does, whether the room (10) is in use.

The sixth aspect of the present invention may further limit false determination of presence or absence of a person.

BRIEF DESCRIPTION OF THE DRAWINGS

FIG. 7 is a timing diagram illustrating temporal changes in result of detection by a motion detector in each indoor unit, and in control phase of the outdoor controller.

DESCRIPTION OF EMBODIMENTS

Described hereinafter are embodiments of the present invention, with reference to the drawings. Note that the embodiments are essentially preferable examples, and are not intended to limit the scopes of the present invention, of the application of the present invention, or of the use of the present invention.

<<First Embodiment>>

<Configuration of Air Conditioning System>

Figure 1:
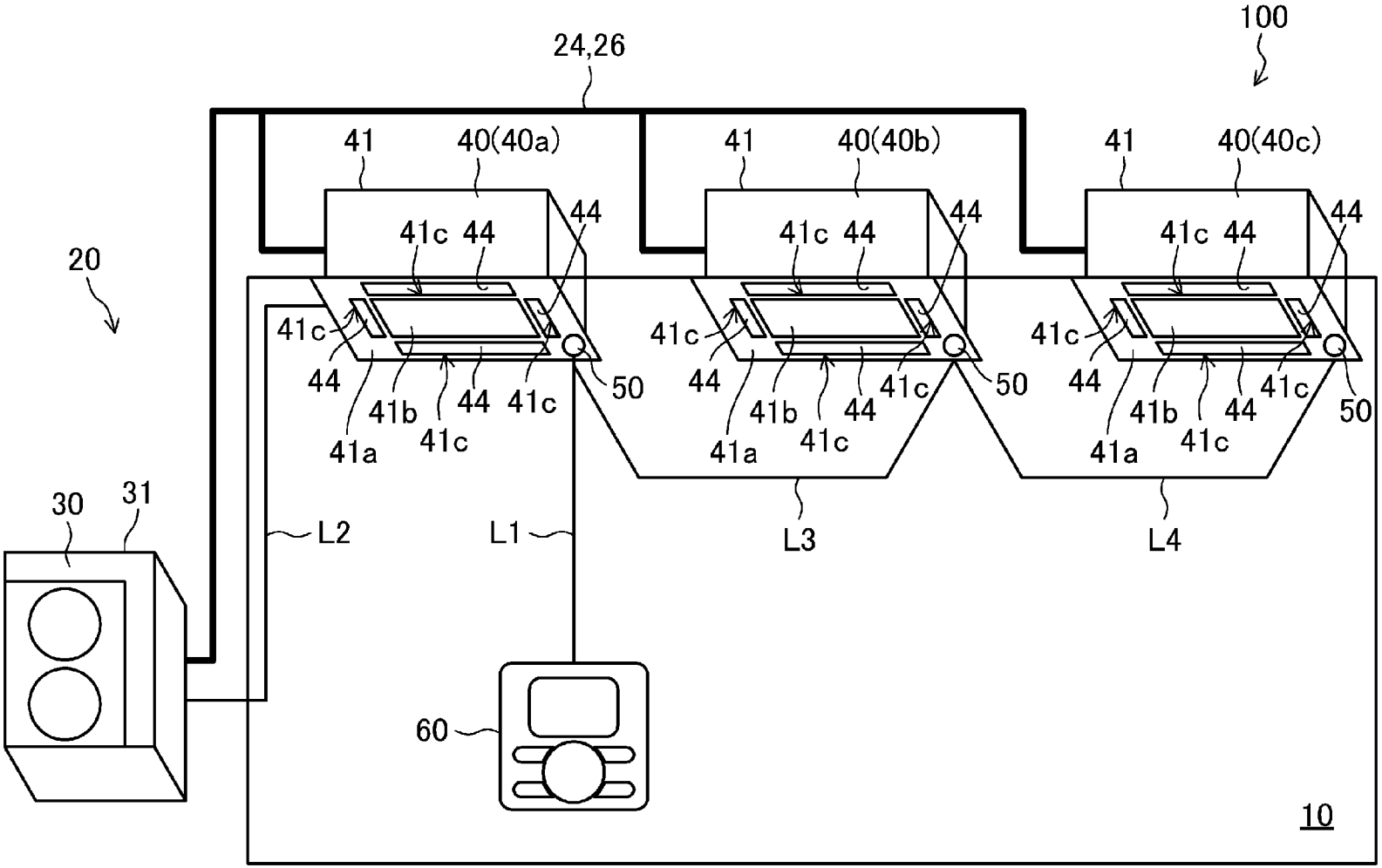
FIG. 1 illustrates a general configuration of an air conditioning system.

FIG. 1 illustrates a general configuration of an air conditioning system (100). As illustrated in FIG. 1, the air conditioning system (100) includes an air conditioner (20), multiple motion detectors (50), and one A/C controller (60).

The air conditioner (20) carries out an air conditioning operation which involves adjusting a temperature and humidity of air in a room (10) to desired ones. Specifically, the air conditioning operation includes, for example, a cooling operation, a heating operation, and a dehumidification operation. The air conditioner (20) includes one outdoor unit (30) and multiple indoor units (40). The outdoor unit (30) is placed out of a building. The multiple indoor units (40) are connected to the outdoor unit (30) via refrigerant pipes (24, 26). The multiple indoor units (40) and the outdoor unit (30) belong to a common control system. The multiple indoor units (40) are installed in a ceiling of a common room (10) in the building.

Note that the multiple indoor units (40) are each referred to as an "indoor unit (40*a*)", an "indoor unit (40*b*)", and an "indoor unit (40*c*)" only if the multiple indoor units (40) need to be individually identified.

Each of the motion detectors (50) is provided to an under surface (41*a*) of a different one of the indoor units (40). Each motion detector (50) includes a pyroelectric sensor which pyroelectrically detects infrared radiation. The motion detector (50) detects presence of a person in the room (10), based on the amount of the infrared radiation. Note that the detection operation by the motion detectors (50) will be described in detail in "<Operation for Determining Presence or Absence of Person>".

The A/C controller (60) is provided to a wall of the room (10). The A/C controller (60) is directly connected to the indoor unit (40*a*), acting as a parent unit, via electrical wiring (LI). Note that the outdoor unit (30) and the indoor unit (40*a*) acting as the parent unit are communicably connected to each other via electrical wiring (L2). The indoor unit (40*a*) and the indoor unit (40*b*) acting as a child unit are communicably connected to each other via electrical wiring (L3). The indoor unit (40*b*) and the indoor unit (40*c*) acting as another child unit are communicably connected to each other via electrical wiring (L4). Hence, it may also be said that the A/C controller (60) is connected to the other indoor units (40*b*, 40*c*) and the outdoor unit (30) via the indoor unit (40*a*). When receiving various instructions for operations from a user, the A/C controller (60) comprehensively controls the outdoor unit (30) and the indoor units (40) based on the instructions for operations.

Specifically, the air conditioning operation of the air conditioner (20) in the air conditioning system (100) is automatically suspended when a degree of occupancy of the room (10) changes from an in-use state to a vacant state. When the degree of occupancy of the room (10) changes from the vacant state to the in-use state, in contrast, the air conditioning operation is automatically resumed.

<Configurations of Outdoor Unit and Indoor Unit>

Figure 2:
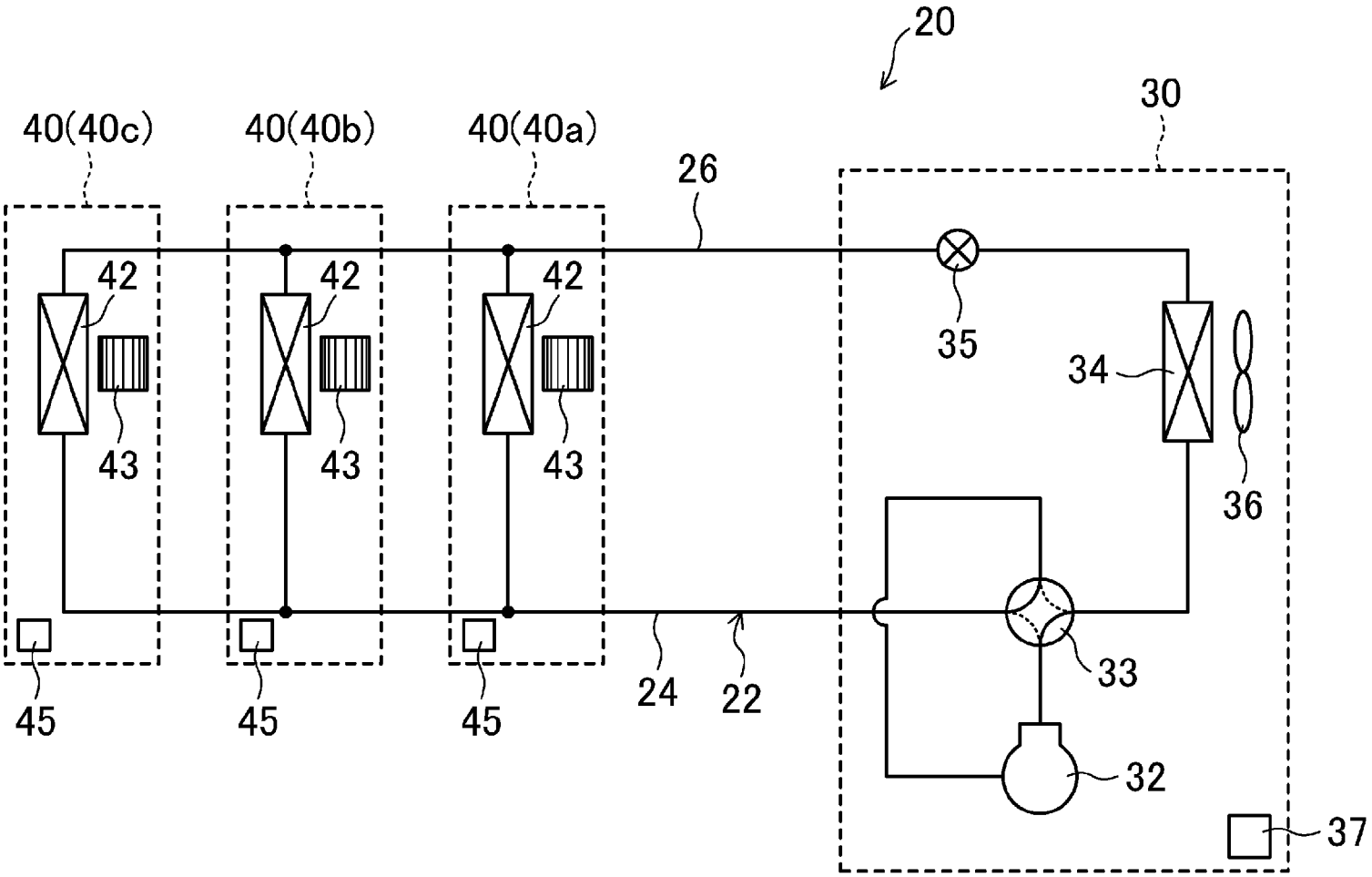
FIG. 2 is a diagram of a refrigerant circuit including one outdoor unit and multiple indoor units.

Briefly described here are configurations of the outdoor unit (30) and the indoor units (40), with reference to FIGS. 1 and 2. FIG. 2 is a diagram of a refrigerant circuit (22) including the one outdoor unit (30) and the multiple indoor units (40).

The refrigerant circuit (22) is formed of the one outdoor unit (30) and the multiple indoor units (40). The indoor units (40) are connected in parallel to the one outdoor unit (30) via the refrigerant pipes (24, 26). The refrigerant circuit (22) is charged with refrigerant, such as R32, and the refrigerant circulates within the refrigerant circuit (22).

The outdoor unit (30) mainly includes an outdoor casing (31), a compressor (32), a four-way switching valve (33), an outdoor heat exchanger (34), an expansion valve (35), an outdoor fan (36), and an outdoor controller (37) which is equivalent to a controller.

The outdoor casing (31) is shaped into a relatively high cuboid. The outdoor casing (31) houses the compressor (32), the four-way switching valve (33), the outdoor heat exchanger (34), the expansion valve (35), the outdoor fan (36), and the outdoor controller (37). The compressor (32) compresses the refrigerant. In switching between the cooling operation and the heating operation, the four-way switching valve (33) switches a flow direction of the refrigerant in the refrigerant circuit (22) either to a solid-line direction or to a dotted-line direction in FIG. 2. The outdoor heat exchanger (34) exchanges heat between outdoor air and the refrigerant by functioning (i) as a radiator for the refrigerant in the cooling operation, and (ii) as an evaporator for the refrigerant in the heating operation. The expansion valve (35) is a throttle valve to decompress the refrigerant, and adjusts a flow rate of the refrigerant in the refrigerant circuit (22). The outdoor fan (36) supplies the outdoor air to the outdoor heat exchanger (34). The outdoor controller (37) is a microcomputer including a central processing unit (CPU) and a memory, for example. The outdoor controller (37) controls the drive of the compressor (32) and the outdoor fan (36), for example.

In particular, based on an output signal sent from the parent indoor unit (40*a*) to indicate a detection result of a person, the outdoor controller (37) of this first embodiment controls the air conditioning operation of the air conditioner (20). This control will be described in detail in <Air Conditioning System Operation>.

The multiple indoor units (40) share the same configuration. Each of the indoor units (40) mainly includes an indoor casing (41), an indoor heat exchanger (42), an indoor fan (43), multiple flaps (44), and an indoor controller (45) which is equivalent to a controller.

The indoor casing (41) is shaped into an approximate cuboid, and houses the indoor heat exchanger (42), the indoor fan (43), and the indoor controller (45). The under surface (41*a*) of the indoor casing (41) has one inlet (41*b*) and multiple outlets (41*c*) arranged to surround the inlet (41*b*). The indoor heat exchanger (42) exchanges heat between air in the room (10) and the refrigerant by functioning (i) as a radiator for the refrigerant in the cooling operation, and (ii) as an evaporator for the refrigerant in the heating operation. The indoor fan (43) creates airflow. The airflow includes: air in the room (10) to be sucked from the inlet (41*b*) into the indoor casing (41); and other air, after the heat exchange, to be blown into the room (10) via the outlets (41*c*). The multiple flaps (44) are provided to the under surfaces (41*a*) of the respective indoor casings (41). Each of the multiple flaps (44) is placed to, and opens and closes, a corresponding one of the outlets (41*c*). The flaps (44) may swing at various angles with respect to the under surfaces (41*a*). The flaps (44) guide the air, blown from the outlets (41*c*) after the heat exchange, in a direction in which the user desires. The indoor controller (45) is a microcomputer including a CPU and a memory, for example. The indoor controller (45) controls the drive of the indoor fan (43) and the state of each flap (44), for example.

<Operation for Determining Presence or Absence of Person>

Figure 3:
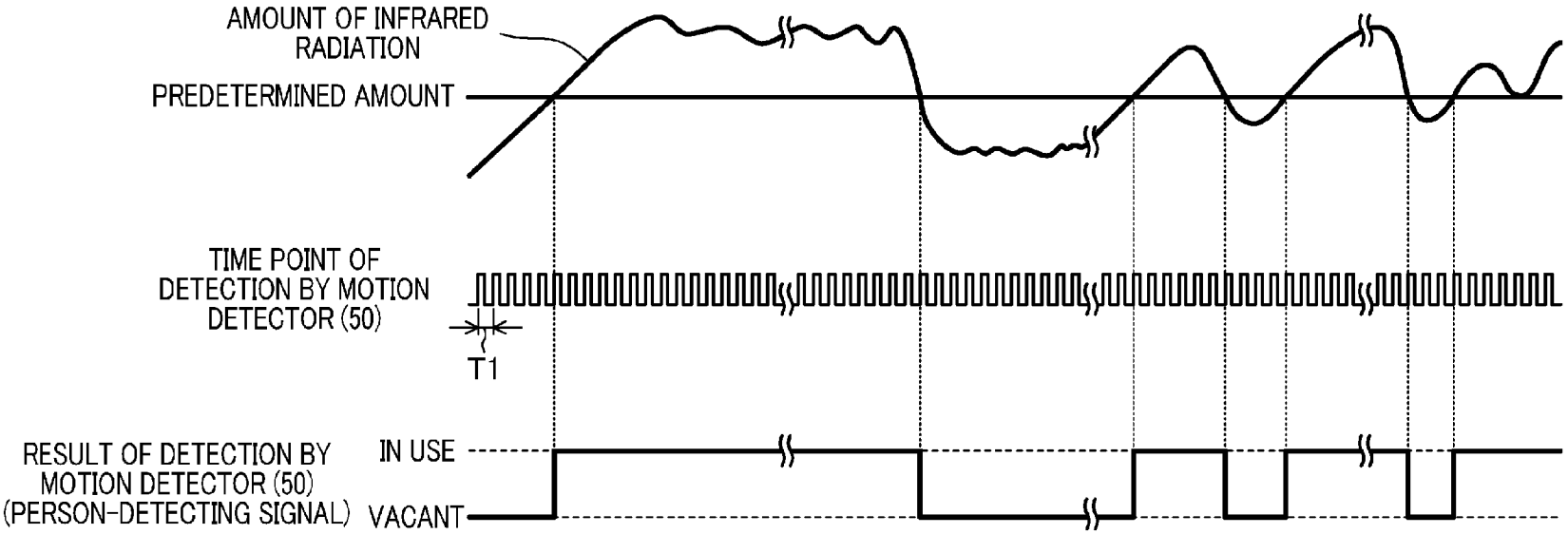
FIG. 3 is a timing diagram illustrating temporal changes in amount of infrared radiation, in detecting time point of a motion detector, and in result of detection by the motion detector.
Figure 4:
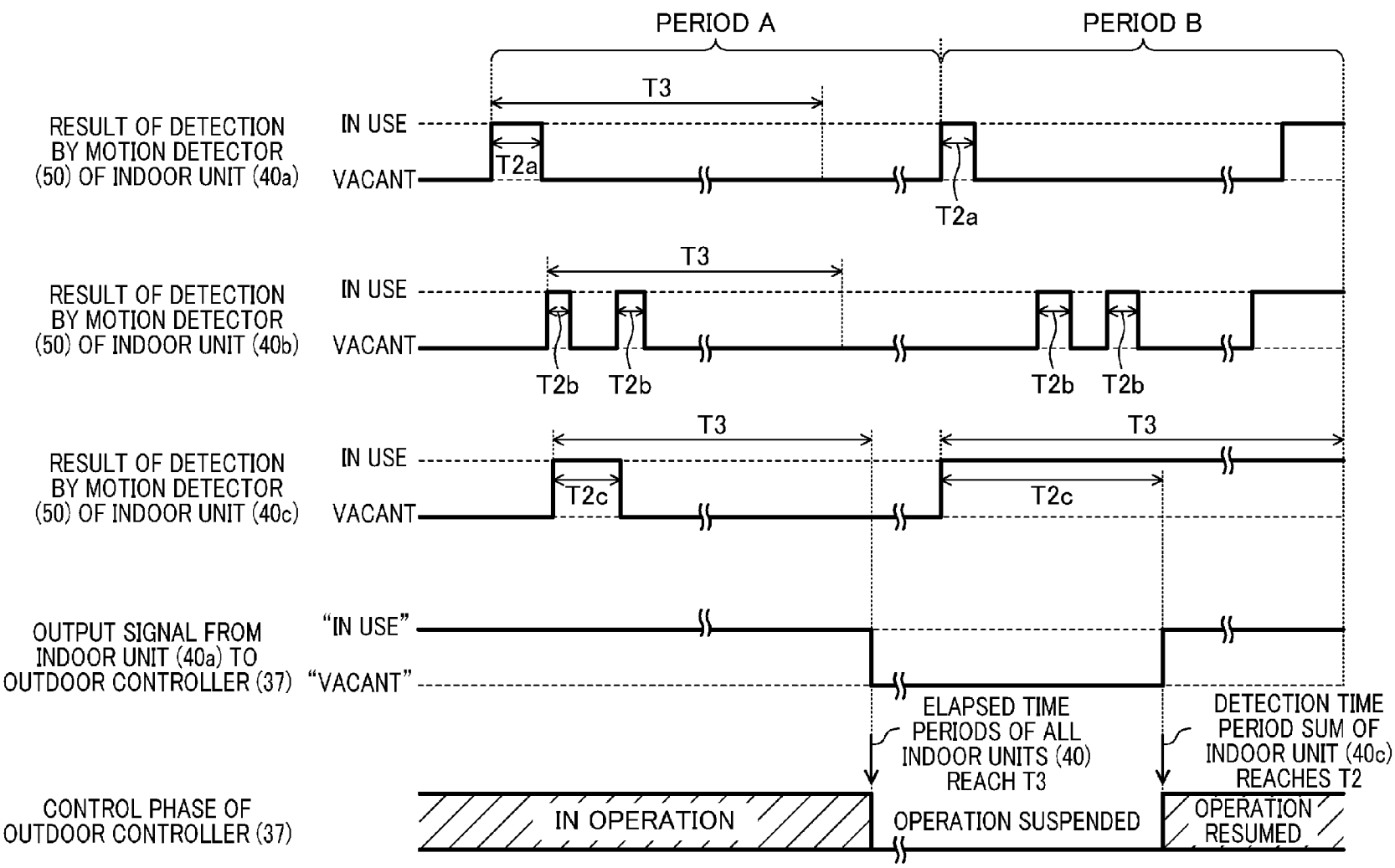
FIG. 4 is a timing diagram illustrating temporal changes in result of detection by a motion detector of each indoor unit, in output signal from an indoor unit (i.e., a parent unit) to an outdoor controller, and in control phase of the outdoor controller.

Among the controllers (37, 45), the indoor controller (45) of the parent indoor unit (40*a*) in particular carries out an operation to reliably determine presence or absence of a person in the room (10), in accordance with the result of detection by each of the motion detectors (50). Here, the operation is described with reference to FIGS. 3 and 4. FIG. 3 is a timing diagram illustrating temporal changes in amount of infrared radiation, in detecting time point of the motion detectors (50), and in result of detection by motion detectors (50). FIG. 4 is a timing diagram illustrating temporal changes in result of detection by the motion detectors (50) of the respective indoor units (40*a*, 40*b*, 40*c*), in output signal from the parent indoor unit (40*a*) to the outdoor controller (37), and in control phase of the outdoor controller (37).

Suppose the amount of the infrared radiation in the room (10) has changed as illustrated in FIG. 3. Each motion detector (50) detects the amount of the infrared radiation for each predetermined cycle (T1) of, for example, one second. If the detected amount of the infrared radiation is greater than a predetermined amount, the motion detector (50) outputs, to the indoor controller (45) in the same indoor units (40), the result of detection "in-use" indicating the presence of a person in the room (10). If the detected amount of the infrared radiation is smaller than the predetermined amount, the motion detectors (50) outputs the result of detection "vacant" indicating that the room (10) is vacant. The predetermined amount is determined appropriately in accordance with, for example, an environmental condition in the room (10).

The indoor controller (45) provides the result of detection by the motion detectors (50) with an identification number for identifying the indoor units (40) of the indoor controller (45) itself. The indoor controller (45) then transmits, to the indoor controller (45) of the parent indoor unit (40*a*), the result of detection having the identification number in the form of a person-detecting signal.

When the indoor controller (45) of the parent indoor unit (40*a*) receives person-detecting signals from all the indoor units (40) including that from the parent indoor unit (40*a*) itself, the indoor controller (45) starts to measure, for each indoor unit (40) (i.e., for each motion detector (50)), a time period elapsed since the time point when the result of detection by the motion detector (50) changes from the "vacant" to the "in use". In other words, the indoor controller (45) starts to measure a time period elapsed since the time point when the motion detector (50) starts to detect the presence of the person. The indoor controller (45) of the indoor unit (40*a*) then obtains a detection time period sum by summing, for each motion detector (50), time periods indicating that the result of detection by the motion detector (50) is the "in-use". If any one of detection time period sums for the respective motion detectors (50) has reached a reference value (T2) of, for example, ten seconds, before the elapsed time period being measured reaches a predetermined time period (T3) of, for example, one minute, the indoor controller (45) of the indoor unit (40*a*) determines that the room (10) is reliably in use and outputs the output signal "in use" to the outdoor controller (37) as a period B in FIG. 4 illustrates.

Hence, in this first embodiment, an example pattern in which the room (10) is determined to be reliably in use is the case when any one of the motion detectors (50) continuously indicates the result of detection "in use" for a time period of the reference value (T2) as illustrated in, for example, the period B. Although not shown, another example pattern in which the room (10) is determined to be reliably in use is the following case: Even when any given motion detector (50) indicates the result of detection "in use" over interrupted time periods, the sum of the interrupted time periods, indicating the result of detection "in use", has reached the reference value (T2) before the elapsed time period being measured reaches the predetermined time period (T3). As can be seen in this first embodiment, the presence or absence of a person in the room (10) is not determined based only on a momentary result of detection by each motion detector (50). Instead, it can be said that the presence or absence of a person in the room (10) is detected based on multiple results of detection by each motion detector (50). As a result, the air conditioning system (100) may limit a false determination that the room (10) is in use when a person simply passes through the room (10).

As an example, the period B in FIG. 4 shows that detection time period sums "T2*a*" and "T2*b*", indicating the results of detection by the motion detectors (50) of the respective indoor units (40*a*, 40*b*), have not reached the reference value (T2) within the predetermined time period (T3). However, a detection time period sum "T2*c*", indicating the result of detection by the motion detector (50) of the indoor unit (40*c*), has reached the reference value (T2) within the predetermined time period (T3). Based on this "T2*c*", the indoor controller (45) of the indoor unit (40*a*) determines that a person is reliably present in the room (10).

However, as the period A in FIG. 4 shows that if none of the detection time period sums "T2*a*", "T2*b*", or "T2*c*" for the respective indoor units (40*a*,40*b*, 40*c*) reaches the reference value (T2), and the elapsed time periods being measured reach the predetermined time period (T3), the indoor controller (45) of the indoor unit (40*a*) determines that the room (10) is not in use, and outputs an output signal "vacant" to the outdoor controller (37). Then, the indoor controller (45) resets the detection time period sums and the elapsed time periods, and ends the measurement of the elapsed time periods. This is because the person might have simply passed through the room (10).

Here, to carry out a detection operation, the motion detectors (50) have a predetermined cycle (T1) of one second, a predetermined time period (T3) of one minute, and a reference value (T2) of ten seconds. However, these time periods are set appropriately after satisfying a condition in which the time periods are longer in the order of the predetermined cycle (T1), the reference value (T2), and the predetermined time period (T3). For example, the predetermined cycle (T1) may be determined based on the specifications of the motion detectors (50), and the predetermined time period (T3) and the reference value (T2) may be determined based on, for example, the size of the room (10).

<Operation of Air Conditioning System>

Figure 5:
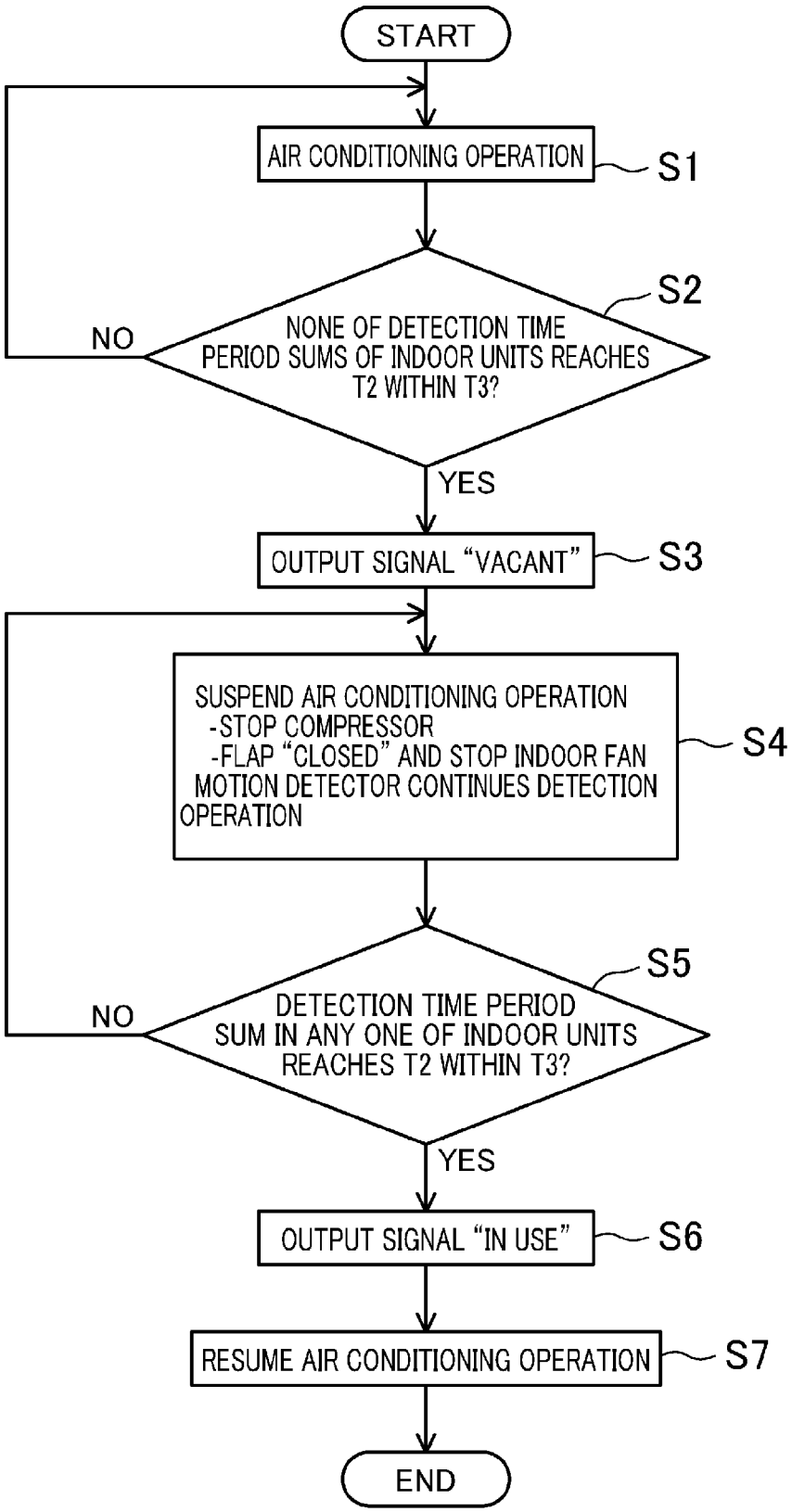
FIG. 5 illustrates an operational flow of the air conditioning system.

Described next is an operational flow of the air conditioning system (100), mainly with reference to FIG. 5. FIG. 5 illustrates an operational flow of the air conditioning system (100).

During the air conditioning operation of the air conditioner (20) (Step S1), the indoor controller (45) of the parent indoor unit (40*a*) carries out the operation for determining the presence or absence of a person based on the person-detecting signals to be sent from all the indoor units (40). If, in all the indoor units (40), none of the detection time period sums reaches the reference value (T2) within the predetermined time period (T3) (Step S2: Yes), the outdoor controller (37) causes the air conditioner (20) to suspend the air conditioning operation (Step S4, see the period A in FIG. 4), in response to the output signal "vacant" (Step S3: Yes) to be output from the indoor unit (40*a*).

When the air conditioning operation is suspended, the operations indicated in Step S4 are carried out while each of the motion detectors (50) continues to be ready to detect the presence or absence of a person, and the indoor controller (45) of the indoor unit (40*a*) continues to be ready to carry out the operation to determine the presence or absence of the person. Specifically, the outdoor controller (37) stops the compressor (32) of the outdoor unit (30), and closes the flaps (44) and stops the indoor fans (43) of all the indoor units (40) (i.e., a forced thermostat-off operation). Note that immediately before causing the air conditioner (20) to suspend the air conditioning operation, the outdoor controller (37) causes the indoor controllers (45) to store angular positions of the flaps (44) with respect to the under surfaces (41*a*) of the indoor casings (41).

In Step S2, even if there is only one indoor unit (40) of which the detection time period sum reaches the reference value (T2) within the predetermined time period (T3) (Step S2: No), the air conditioning operation in Step SI continues.

If, in any one of the indoor units (40), the detection time period sum reaches the reference value (T2) within the predetermined time period (T3) during the suspension of the air conditioning operation in Step S4 (Step S5: Yes), the outdoor controller (37) causes the air conditioner (20) to resume the air conditioning operation (Step S7, see the period B in FIG. 4) in response to the output signal "in use" (Step S6) to be output from the indoor unit (40*a*).

The resumption of the air conditioning operation in Step S7 causes the compressor (32) in the outdoor unit (30) to resume driving. The flaps (44) of the indoor units (40) swing to the angular positions stored in the indoor controllers (45) immediately before the suspension of the air conditioning operation, and the indoor fans (43) resume driving (i.e., a thermostat-on operation).

<Effects of First Embodiment>

The air conditioner (20) of the air conditioning system (100) according to this first embodiment suspends the air conditioning operation when the room (10) is vacant. When the degree of occupancy of the room (10) changes from the vacant state to the in-use state, a detection time period sum is obtained for each of the motion detectors (50). If any one of the detection time period sums for the respective motion detectors (50) reaches the reference value (T2) within the predetermined time period (T3) after the motion detector (50) starts to detect the presence of a person, the room (10) is determined to be actually in use. Consequently, the air conditioning operation is resumed. Such features may limit, for example, false determination—that is, a person simply passing through the room (10) is determined to be the occupant of the room (10)—, and the resulting resumption of the air conditioning operation. The limitation of resuming the air conditioning operation may avoid wasteful consumption of power among all the indoor units (40).

Moreover, during the suspension of the air conditioning operation in the air conditioning system (100) according to this first embodiment, the flaps (44) close the outlets (41*c*), and the indoor fans (43) stop. Such features allow the indoor units (40) to appear to stop their operations. Hence, a person entering the vacant room (10) may confirm that the indoor units (40) have actually stopped operating when nobody is present there.

Furthermore, during the suspension of the air conditioning operation in the air conditioning system (100) according to this first embodiment, not only the indoor fans (43) but also the compressor (32) stops. Such a feature allows for reducing the power consumption of the air conditioner (20) during the suspension of the air conditioning operation.

In addition, the air conditioning operation is suspended in the air conditioning system (100) according to this first embodiment, if a controller (37, 45) determines for all the indoor units (40) that the room (10) is vacant during the air conditioning operation. Such a feature allows for limiting the suspension of the air conditioning operation when the room (10) might possibly be in use—that is, for example, when a controller (37, 45) determines that the room (10) is in use for any one of the indoor units (40).

<<Second Embodiment>>

The air conditioning system (100) according to this second embodiment may determine the presence or absence of a person, selectively using either the technique according to the first embodiment or a technique based on a detection time period sum obtained as the sum of time periods detected by the multiple motion detectors (50).

Described below are a configuration of the A/C controller (60) according to this second embodiment, and an operation to determine the presence or absence of a person based on a result of detection by the multiple motion detectors (50).

<A/C Controller>

Figure 6:
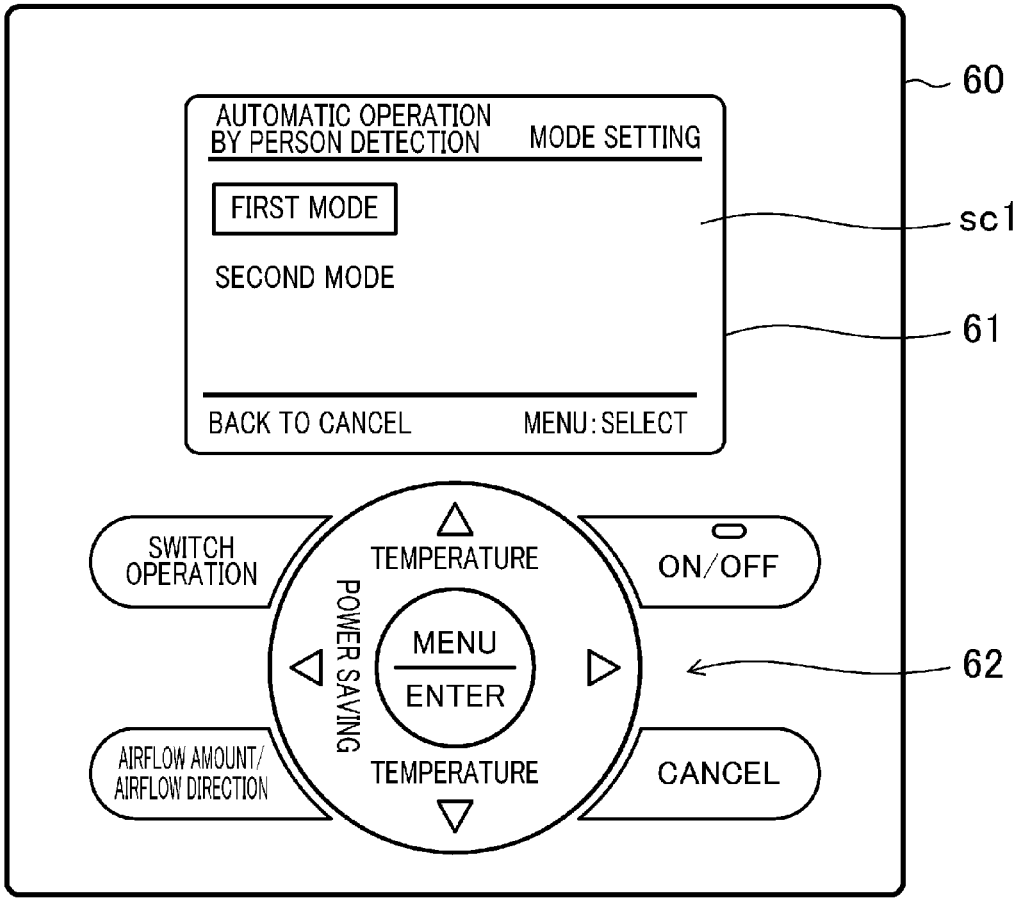
FIG. 6 is an external view of an air conditioning (A/C) controller.

FIG. 6 is an external view of the A/C controller (60). The A/C controller (60) has a display (61), and a group of input buttons (62) acting as a receiver.

The display (61) presents various setting screens for an air conditioning operation. Examples of the setting screens include those for a target temperature and a target humidity.

Specifically, as illustrated in FIG. 6, the display (61) according to this embodiment 2 may display a mode setting screen (sc1). FIG. 6 is an example of the mode setting screen (sc1), used for the operation to determine the presence or absence of a person, when a suspended air conditioning operation is resumed. The mode setting screen (sc1) displays a first mode and a second mode so that the user may select either mode. During the suspension of the air conditioning operation, the first mode involves the following: obtaining a detection time period sum for each motion detector (50) provided to one of the indoor units (40*a*, 40*b*, 40*c*); and determining the presence or absence of a person based on the obtained detection time period sums. During the suspension of the air conditioning operation, the second mode involves the following: selecting at least two of the motion detectors (50) each provided to one of the indoor units (40*a*, 40*b*,40*c*) such that the two motion detectors (50) are targets for obtaining a detection time period sum; and determining the presence or absence of a person based on the obtained detection time period sum.

The group of input buttons (62) is used when the user carries out his or her desired setting with reference to various setting screens displayed on the display (61). In particular, when the display (61) presents the mode setting screen (sc1) in FIG. 6, the group of input buttons (62) receives the selection by the user of either the first mode or the second mode.

If the first mode is selected, it is the indoor controller (45) of the parent indoor unit (40*a*) that mainly carries out the operation to determine the presence or absence of a person, as described in first embodiment. If the second mode is selected, it is the A/C controller (60), instead of the indoor controller (45) of the indoor unit (40*a*), that mainly carries out the operation to determine the presence or absence of a person as described below.

<Operation in Second Mode for Determining Presence or Absence of Person>

Figure 7:
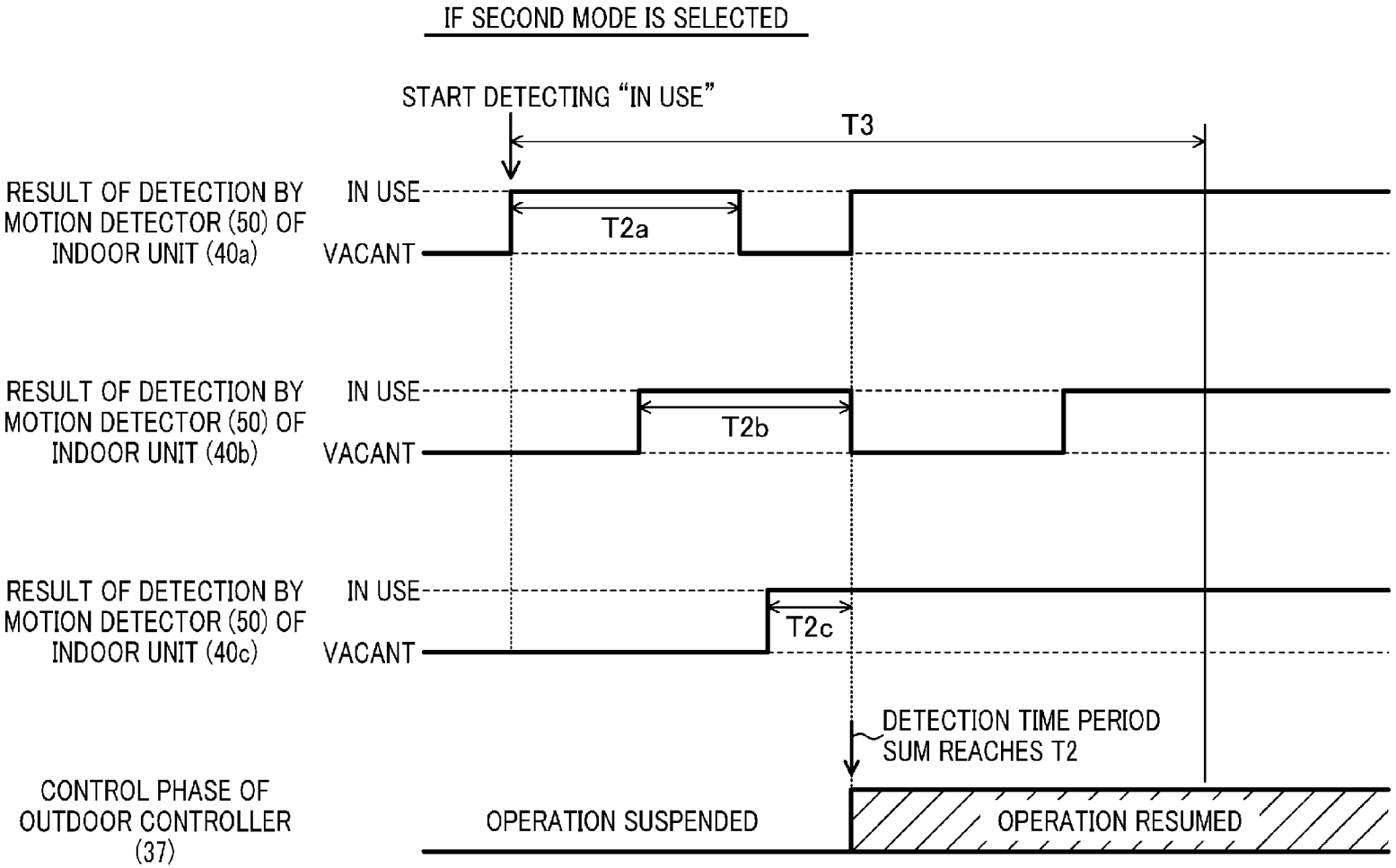
FIG. 7 illustrates an operation in a second mode for determining presence or absence of a person.

FIG. 7 illustrates an operation in the second mode for determining the presence or absence of a person. FIG. 7 is a timing diagram illustrating temporal changes in result of detection by the motion detectors (50) in the respective indoor units (40*a*, 40*b*, 40*c*), and in control phase of the outdoor controller (37).

First, during the suspension of the air conditioning operation, the indoor units (40*a*, 40*b*, 40*c*) send the A/C controller (60) results of detection (i.e., person-detecting signals) by the motion detectors (50). Each of the results of detection is provided with a corresponding one of identification numbers of the respective indoor units (40). FIG. 7 illustrates an example case when the A/C controller (60) selects all the motion detectors (50) to be the targets for obtaining a detection time period sum.

Specifically, suppose the following operations are carried out during the suspension of the air conditioning operation as illustrated in FIG. 7: First, the indoor unit (40*a*) outputs the result of detection "in use" for a time period (T2*a*); next, the indoor unit (40*b*) outputs the result of detection "in use" for a time period (T2*b*); and furthermore, the indoor unit (40*c*) outputs the result of detection "in use" for longer than or equal to a time period (T2*c*). In this case, the A/C controller (60) starts to measure the elapsing time periods as soon as the indoor unit (40*a*) starts to output the result of detection "in use". Then, the A/C controller (60) sums the time periods (T2*a*, T2*b*, T2*c*) in which the indoor units (40*a*, 40*b*,40*c*) output the results of detection "in use", and obtains the resulting sum as the detection time period sum (T2*a*+T2*b*+T2*c*). If the detection time period sum (T2*a*+T2*b*+T2*c*) has reached the reference value (T2) before the time periods being measured reach the predetermined time period (T3), the A/C controller (60) determines that the room (10) is reliably in use and outputs the output signal "in use" to the outdoor controller (37). Such features allow the outdoor controller (37) to drive the stopped compressor (32) to resume the suspended air conditioning operation.

If the detection time period sum (T2*a*+T2*b*+T2*c*) does not reach the reference value (T2), and the measured time periods reach the predetermined time period (T3), the air conditioning operation remains suspended.

Note that, during the air conditioning operation, if the detection time period sum (T2*a*+T2*b*+T2*c*) does not reach the reference value (T2) and the time periods being measured reach the predetermined time period (T3), the A/C controller (60) may determine that the room (10) is vacant.

<Effects of Second Embodiment>

As illustrated in FIG. 6, the air conditioning system (100) according to this second embodiment allows the user to select either the first mode or the second mode, using the A/C controller (60). If the first mode is selected, a detection time period sum is obtained for each of the motion detectors (50). If the second mode is selected, the results detected by the multiple motion detectors (50) are summed to be a detection time period sum. As a result, the second mode allows for determining, relatively more quickly than the first mode does, whether the room (10) is in use.

<Modification of Second Embodiment>

The second mode tends to cause a false detection of presence or absence of a person, if targets for obtaining the detection time period sum include the motion detector (50) of an indoor unit (40) at a busy location such as a doorway of the room (10). Since the motion detector (50) of the indoor unit (40) at the busy location has a chance to frequently detect people, the time periods detected by the motion detector (50) are the targets for obtaining the detection time period sum. Consequently, the detection time period sum inevitably reaches the reference value (T2) quickly.

Thus, the second mode may include a setting to rule out a motion detector (50), of a predetermined indoor unit in the multiple indoor units (40), from among the targets for obtaining the detection time period sum, using the group of input buttons (62) on the A/C controller (60). The motion detector (50) of the predetermined indoor unit (40) includes that of an indoor unit (40) installed at a busy location, such as a doorway of the room (10).

When such a setting is established, the A/C controller (60) either refuses to receive a person-detecting signal from the predetermined indoor unit (40) with the setting established, or refuses to use the received person-detecting signal, if any, for the calculation of the detection time period sum. Alternatively, the air conditioning system (100) may limit the predetermined indoor unit (40) from transmitting the person-detecting signal.

Such features allow for ruling out, for example, a motion detector (50), of a predetermined indoor unit (40) at a busy location, from among the targets for obtaining a detection time period sum, thereby further limiting false determination in presence or absence of a person.

<<Other Embodiments>>

The first and second embodiments may include the configurations below.

When the air conditioning operation is suspended, the circulation of the refrigerant in the refrigerant circuit (22), instead of the drive of the compressor (32), may stop. The expansion valve (35) may be opened to a smaller degree when the circulation of the refrigerant is stopped than while the air conditioning operation is being carried out.

Moreover, the indoor fans (43) may be rotated at a slower speed, instead of being stopped driving, when the air conditioning operation is suspended than while the air conditioning operation is being carried out.

Furthermore, the flaps (44) of the indoor units (40) do not have to completely close the outlets (41*c*) when the air conditioning operation is suspended. For example, the flaps (44) may be angled with respect to the under surfaces (41*a*) of the indoor casings (41) so that interiors of the indoor casings (41) are sufficiently invisible from the under surfaces (41*a*) through the outlets (41*c*).

In addition, the condition for suspending the air conditioning operation does not have to be the case when all the indoor units (40) determine the room (10) is vacant. The A/C controller (60) may suspend the air conditioning operation if at least one of the indoor units (40) determines the room (10) is vacant, additionally based on a position at which each indoor unit (40) is installed.

Moreover, the air conditioner (20) may include multiple outdoor units (30) and indoor units (40) in multiple control systems.

Furthermore, all the multiple indoor units (40) do not have to be the same type of indoor unit. The multiple indoor units (40) may include a different type of indoor unit.

In addition, all the operational controls, including determination of presence or absence of a person and suspension of the air conditioning operation, may be carried out by the A/C controller (60), instead of the indoor controllers (45) and the outdoor controller (37). All the operational controls may also be carried by the outdoor controller (37).

INDUSTRIAL APPLICABILITY

As can be seen, the present invention is useful for an air conditioning system including multiple indoor units each equipped with a motion detector.

DESCRIPTION OF REFERENCE CHARACTERS

10 In Room
20 Air Conditioner
30 Outdoor Unit
32 Compressor
37 Outdoor Controller (Controller)
40 Indoor Unit
41 Indoor Casing
41*c* Outlet
43 Indoor Fan
44 Flap
45 Indoor Controller (Controller)
50 Motion Detector
60 A/C Controller (Controller)
62 Group of Input Buttons (Receiver)
100 Air Conditioning System
T2 Reference Value
T3 Predetermined Time Period

The invention claimed is:

1. An air conditioning system comprising:

an air conditioner including an outdoor unit and a plurality of indoor units belonging to a common control system, the plurality of indoor units being installed in a common room and each having an indoor unit controller;

a plurality of motion detectors, each motion detector being provided at an associated one of the plurality of indoor units, and configured to detect presence of a person in the room; and a parent indoor unit controller configured to cause the air conditioning system to suspend an air conditioning operation if the room is vacant, wherein each of the indoor unit controllers is configured to continuously receive motion detection signals from a respective one of the plurality of motion detectors at a first predefined time interval and transmit, to the parent indoor unit controller, a detection result signal including a corresponding identification number;

if, while the air conditioning operation is suspended, at least one of the detection result signals indicates the presence of a person, the parent indoor unit controller:

obtains a detection time period sum for two or more of the plurality of indoor unit controllers by summing, for a second predetermined time period, time periods in which the detection result signal indicates presence of the person; and causes the air conditioner to resume the air conditioning operation if the detection time period sum obtained from any one of the two or more plurality of indoor unit controllers reaches a reference value within the second predetermined time period.

2. The air conditioning system of claim 1, wherein each indoor unit further includes:

an indoor casing having an outlet from which air is blown into the room;

a flap placed to, and capable of opening and closing, the outlet; and an indoor fan creating a flow of the air blown from the outlet, and the indoor unit controller of a respective indoor unit closes the flap and stops the indoor fan during the suspension of the air conditioning operation.

3. The air conditioning system of claim 1, wherein the outdoor unit includes a controller and a compressor, and the outdoor unit controller stops the compressor included in the outdoor unit, during the suspension of the air conditioning operation.

4. The air conditioning system of claim 1, wherein the parent indoor unit controller causes the air conditioning system to suspend the air conditioning operation, if determining for all the indoor units that the room is vacant.

5. The air conditioning system of claim 1, wherein the parent indoor unit controller is configured to obtain, during a first mode, the detection time period sum for each of the plurality of indoor unit controllers; and obtain, during a second mode, the detection time period sum for at least two of the indoor unit controllers; and the air conditioning system further comprises a receiver configured to be capable of selectively receiving selection of one of the first mode or the second mode.

6. The air conditioning system of claim 5, wherein in the second mode, the receiver is further capable of receiving a setting to rule out a motion detector, of a predetermined one of the indoor units, from among targets for obtaining the detection time period sum, the ruled out motion detector being included in the motion detectors.

7. The air conditioning system of claim 2, wherein the parent indoor unit controller is configured to obtain, during a first mode, the detection time period sum for each of the plurality of indoor unit controllers; and obtain, during a second mode, the detection time period sum for at least two of the indoor unit controllers; and the air conditioning system further comprises a receiver configured to be capable of selectively receiving selection of one of the first mode or the second mode.

8. The air conditioning system of claim 3, wherein the parent indoor unit controller is configured to obtain, during a first mode, the detection time period sum for each of the plurality of indoor unit controllers; and obtain, during a second mode, the detection time period sum for at least two of the motion indoor unit controllers; and the air conditioning system further comprises a receiver configured to be capable of selectively receiving selection of one of the first mode or the second mode.

9. The air conditioning system of claim 4, wherein the parent indoor unit controller is configured to obtain, during a first mode, the detection time period sum for each of the plurality of indoor unit controllers; and obtain, during a second mode, the detection time period sum for at least two of the indoor unit controllers; and the air conditioning system further comprises a receiver configured to be capable of selectively receiving selection of one of the first mode or the second mode.

10. The air conditioning system of claim 7, wherein in the second mode, the receiver is further capable of receiving a setting to rule out a motion detector, of a predetermined one of the indoor units, from among targets for obtaining the detection time period sum, the ruled out motion detector being included in the motion detectors.

11. The air conditioning system of claim 8, wherein in the second mode, the receiver is further capable of receiving a setting to rule out a motion detector, of a predetermined one of the indoor units, from among targets for obtaining the detection time period sum, the ruled out motion detector being included in the motion detectors.

12. The air conditioning system of claim 9, wherein in the second mode, the receiver is further capable of receiving a setting to rule out a motion detector, of a predetermined one of the indoor units, from among targets for obtaining the detection time period sum, the ruled out motion detector being included in the motion detectors.

* * * * *